US005331249A

United States Patent [19]

Minamikata et al.

[11] Patent Number: 5,331,249

[45] Date of Patent: Jul. 19, 1994

[54] DISCHARGE TUBE

[75] Inventors: Hajime Minamikata; Kiyoshi Yagi; Seiichi Wakabayashi, all of Shizuoka, Japan

[73] Assignee: Yazaki Corporation, Tokyo, Japan

[21] Appl. No.: 810,425

[22] Filed: Dec. 20, 1991

Related U.S. Application Data

[63] Continuation-in-part of Ser. No. 408,576, Sep. 18, 1989, abandoned.

[30] Foreign Application Priority Data

Sep. 27, 1988 [JP] Japan ..... 63-239639
Jul. 25, 1989 [JP] Japan ..... 1-190478

[51] Int. Cl.[5] ..... H01J 61/06

[52] U.S. Cl. ..... 313/632; 313/124; 313/349; 313/625; 313/324

[58] Field of Search ..... 313/123, 124, 323, 324, 313/349, 622, 624, 625, 631, 632

[56] References Cited

U.S. PATENT DOCUMENTS 3,270,232 8/1966 Bailey, Jr. et al. ..... 313/38
4,475,055 10/1984 Boettcher ..... 313/632
4,493,003 1/1985 Mickelson et al. ..... 361/119

FOREIGN PATENT DOCUMENTS 848407 3/1982 European Pat. Off. .

OTHER PUBLICATIONS

H. L. Van Der Horst; Discharge Tubes—Phillips Technical Library 1964 pp. 155-156.

*Primary Examiner*—Michael Horabik
*Attorney, Agent, or Firm*—Nikaido, Marmelstein, Murray & Oram

[57] ABSTRACT

A discharge tube of the type wherein a voltage is applied across a pair of electrodes to cause a discharge between the anode side electrode and the cathode side electrode. In the new discharge tube, opposing end portions of the pair of electrodes are formed into a non-acute configuration, and a large number of concave or convex portions are formed on a surface at least of the cathode side electrode. A stabilized high discharge voltage can be obtained from an initial stage of discharging with a comparatively small distance between the electrodes. Further, since the surface area of the electrodes is great, exhaustion of the electrodes are dispersed, and the electrodes are superior in durability. Further, since the distance between the electrodes is small, the discharge maintaining voltage is low and the energy loss is decreased.

8 Claims, 8 Drawing Sheets

DISCHARGE TUBE

This application is a continuation-in-part of application Ser. No. 07/408,576 filed Sep. 18, 1989, "now abandoned".

FIELD OF THE INVENTION

This invention relates to a discharge tube, and more particularly to a discharge tube suitable for use with an ignition device with a series gap of an automobile engine or the like.

BACKGROUND OF THE INVENTION

Generally, discharge tubes wherein gas is enclosed in a tube and a voltage is applied across a pair of electrodes provided at the opposite ends of the tube to cause a discharge between them are used widely in various fields.

FIG. 9 shows a discharge tube 61 which is used with an ignition device C with a series gap of an automobile engine shown in FIG. 10 or the like, and in the discharge tube 61, an electrode 63 in the form of a needle and another electrode 64 in the form of a flat plate are provided at the opposite ends of a cylindrical casing 62. Inert gas is enclosed in the discharge tube 61. The discharge tube 61 acts as a series gap S of the ignition device C, and as the discharge voltage at the series gap S is maintained high to some degree and the voltage across the series gap after discharging is applied to an electrode of an ignition plug P, an ignition voltage necessary for the ignition plug P is obtained without having a significant influence of an electric shunt circuit which may be caused by carbon sticking to the ignition plug P or the like.

However, since the electrode 63 of the discharge tube 61 on the side to which a voltage of an ignition coil 65 is applied is formed into a needle-like configuration as shown in FIGS. 10 and 11 and as described hereinabove, there are problems that a non-uniform electric field is formed between the electrodes 63 and 64 of the discharge tube 61 and readily causes discharging and that the discharge voltage $V_1$ of a voltage characteristic illustrated in FIG. 12 does not present a very high level. Accordingly, in order to raise the discharge voltage $V_1$ of the discharge tube 61 to some degree, the distance between the needle-formed electrode 63 and the flat plate-formed electrode 64, that is, the series gap S, is increased to some degree. However, where the series gap S is increased in this manner, there is a problem that the configuration of the entire discharge tube is increased, and there is another problem that a discharge maintaining voltage $V_2$ of FIG. 12 becomes high and the energy loss during discharging is increased. Also, there is a problem that, since the electrode surface area of the needle-shaped electrode 63 is small, the influence of exhaustion of the electrode by discharging is great and the durability is not so long.

Thus, it may seem recommendable to form the electrodes of the discharge tube 61 as a pair of substantially parallel plate electrodes (Rogosky electrodes) which are often used in experiments of a discharge phenomenon and wherein an end face has a flat face configuration and a circumferential edge portion around the end face is rounded into a curved face configuration in order to approximate an electric field between the electrodes of the discharge tube to a uniform electric field so as to cause a discharge less readily to allow the discharge voltage $V_1$ shown in FIG. 12 to be raised and also to reduce the distance between the electrodes to lower the discharge maintaining voltage $V_2$ to decrease the energy loss.

However, such Rogosky electrode has a characteristic that it is readily influenced by a quantity of electrons floating between the electrodes and electrons are not discharged from the electrodes, and there is a problem that the discharge voltage $V_1$ is not stabilized and is influenced by a frequency of discharges.

SUMMARY OF THE INVENTION

Accordingly, it is an object of the present invention to provide a discharge tube which eliminates such problems of the prior art described above and wherein a high discharge voltage can be obtained with a comparatively small distance between electrodes and the discharge voltage obtained is stabilized.

In order to attain the object, according to the present invention, a discharge tube of the type wherein a voltage is applied across a pair of electrodes to cause a discharge between the anode side electrode and the cathode side electrode is constituted such that substantially opposing end portions of the pair of electrodes are each formed into a non-acute configuration, and a large number of cutouts are formed in the opposing end portion at least of the cathode side electrode in such a manner that the density of cutouts in an end face thereof substantially opposing the other electrode is larger than that in a curved peripheral portion around the end face. No cutouts may be provided in the curved peripheral portion.

Since the substantially opposing end portions of the pair of electrodes are each formed into a non-acute configuration, the electric field between the electrodes can be approximated to a uniform electric field, and since a large number of cutouts are formed in the end face at least of the cathode side electrode substantially opposing the other electrode, also an electric field microscopically approximated to a non-uniform electric field can be formed therein by the cutouts.

DETAILED DESCRIPTION OF EMBODIMENTS

In the following, embodiment of a discharge tube according to the present invention will be described with reference to the drawings.

Figure 1A:
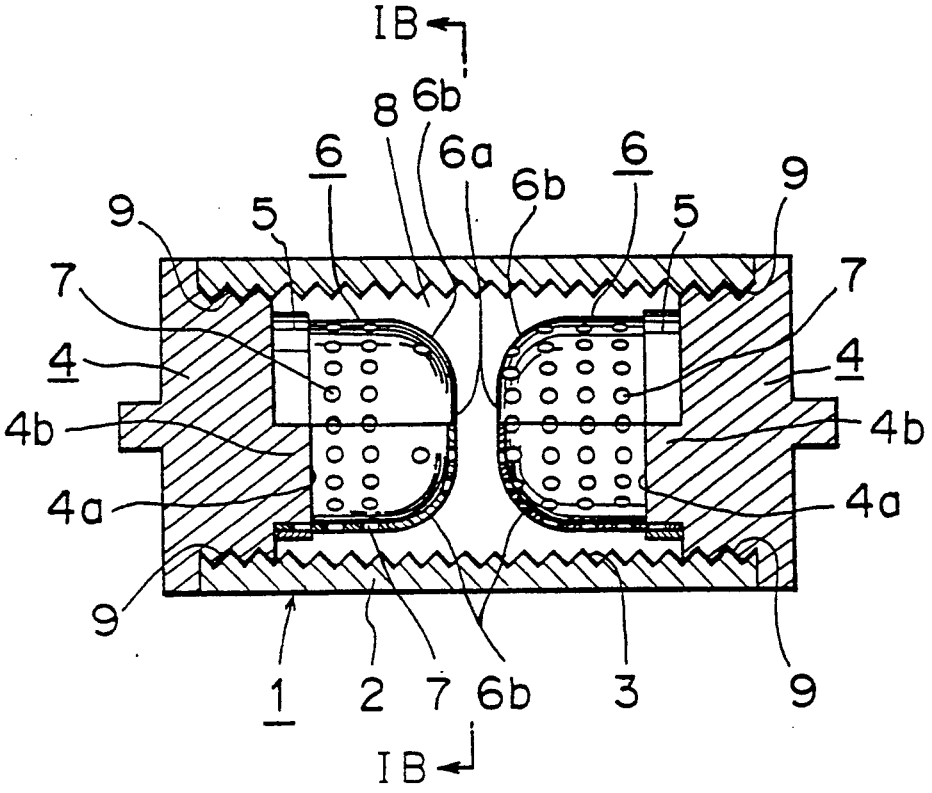
FIG. 1A is a sectional view showing an embodiment of a discharge tube according to the present invention.
Figure 1B:
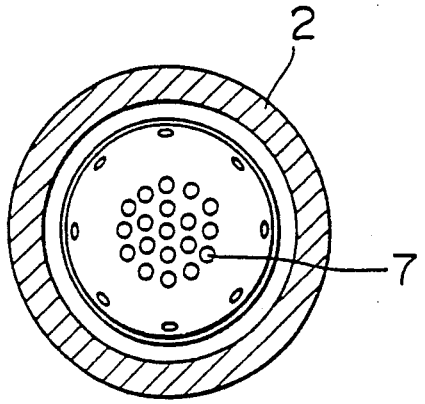
FIG. 1B is a sectional view taken along the line 1B—1B of FIG. 1A.

FIGS. 1A and 1B show an embodiment of the present invention, and in the figures, reference numeral 1 denotes a discharge tube. A casing 2 of the discharge tube 1 is formed as an insulating pipe in the form of a hollow cylinder made of a ceramics material such as, for example, an alumina ceramics material, a steatite material or a crystallized glass material. A screw thread 3 is formed over longitudinal direction on an inner periphery of the casing 2, and a pair of electrode bases 4 made of a metal material are screwed into the casing 2 in such a manner as to close openings at the opposite ends of the casing 2. A pair of Rogosky type electrodes 6 formed from a material suitable for discharging are provided in an opposing spaced relationship by a comparatively small distance on inner faces 4*a* of the individual electrode bases located in the casing 2 with metal rings 5 interposed therebetween.

Each of the Rogosky type electrodes 6 is a kind of substantially flat single plate electrode member having such a non-acute end portion that an end face 6*a* thereof has a flat face configuration and a circumferential edge portion 6*b* around the end face 6*a* is rounded toward the metal ring 5 side into a curved face configuration, but the electrode 6 of the present invention further has a large number of small holes 7 formed in the end portion thereof in such a manner that the density of cutouts in the end face 6*a* is notably larger than that in the circumferential edge portion 6*b*. In forming the Rogosky type electrode 6 having such holes, an etching step or a punching step may be applied to a thin plate of stainless steel having a thickness of, for example, 0.2 mm to form small holes 7 of a diameter of 0.1 to 0.8 mm at a hole pitch of 0.5 to 1.5 mm, and then the thin plate of stainless steel having the small holes 7 perforated therein may be shaped by press work.

Meanwhile, in mounting the Rogosky type electrode 6 on the electrode base 4, a base end portion of the electrode 6 is fitted around a hub portion 4*b* provided projectingly on the inner face 4*a* of the electrode base, and then the metal ring 5 is force fitted on the electrode 6. Here, the electrode base 4 is preferably made of, for example, a 42 alloy material or a cover material having a coefficient of thermal expansion which is substantially equal to that of the casing 2 and is small in value while the metal ring 5 is preferably made of a material having a coefficient of thermal expansion which is substantially equal to or smaller than that of the electrode base 4.

Further, inert gas such as, for example, nitrogen gas is enclosed in an internal spacing 8 of the discharge tube 1, and a location between the casing 2 and each of the electrodes 4 is sealed with a sealing material 9 such as an epoxy type bonding agent, a glass type bonding agent or a brazing material by metallization so that the enclosed gas may not leak to the outside.

Thus, with the construction described above, since the pair of electrodes 6 of the discharge tube 1 are formed such that the electrode distance is made small as the Rogosky type, the electric field between the electrodes 6 of the discharge tube 1 can be approximated to a uniform electric field, and the discharge tube is obtained which does not readily cause discharging and is low in discharge maintaining voltage $V_2$ and low in energy loss. Further, since the large number of small holes 7 are formed in each of the electrodes 6 of the discharge pipe 1 to attain a condition wherein a large number of irregularities such as concave or convex portions are formed on a surface of the electrode 6, an electric field microscopically approximated to a non-uniform electric field is formed by the small holes 7 and a condition is attained wherein electrons are discharged readily. Thus, the discharge tube is obtained wherein the discharge voltage $V_1$ is stabilized, which is a characteristic of a non-uniform electric field, and is not influenced by the frequency of discharges.

Particularly, since small holes 7 are formed in the end portions of the electrodes in such a manner that the density of small holes 7 in the end face 6*a* is notably larger than that in the circumferential edge portion 6*b*, an electric field microscopically approximated to a non-uniform electric field is formed in a centralized manner in the end face 6*a* of the electrodes.

Further, since particularly the pair of electrodes 6 are formed as of the Rogosky type and with small holes 7 densely formed in the end faces 6*a*, such a circumstance that, when a pair of parallel flat plates are disposed merely in an opposing relationship, an electric field is concentrated on a circumferential edge portion of each of the flat plates and has an undesirable influence on the discharge characteristic can be prevented, and discharging can be restricted so that it may take place only in a parallel electric field.

Further, since the casing 2 and the electrode bases 4 have substantially same coefficients of thermal expansion and the electrodes 6 formed from a material suitable for discharging are mounted on the electrode bases 4, the discharge tube 1 can be made with a strong structure against a heat cycle, and a sealing condition between the casing 2 and the electrodes 4 can be maintained to prevent leakage of inert gas enclosed in the tube.

Moreover, since the electrodes 6 are formed as a kind of parallel plate electrodes and have a greater surface area than conventional needle-formed electrodes, the influence of exhaustion of the electrodes by discharging is small and the durability is improved.

It is to be noted that, since in the discharge tube 1 described above, the pair of electrodes 6 disposed in an opposing relationship are both of the Rogosky type having holes of the same configuration perforated therein, the discharge tube itself does not have a directivity that one of the electrodes serves as an anode and the other electrode serves as a cathode, and an impulse signal can be applied to either of the electrodes. Accordingly, the discharge tube 1 can be used also for an ac power source.

Figure 10:
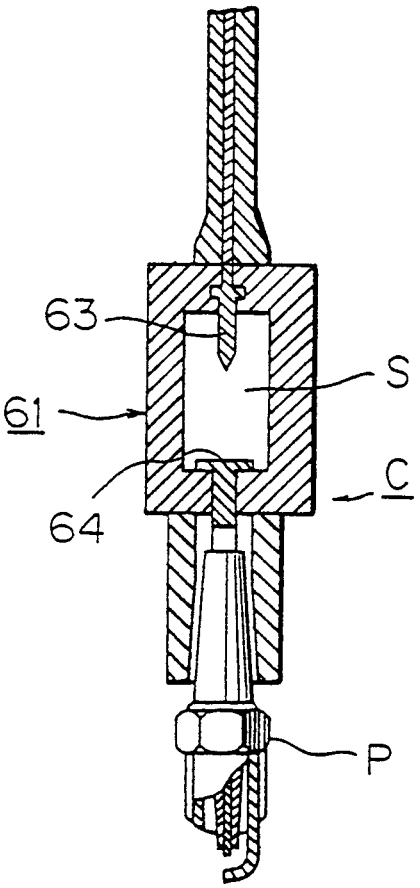
FIG. 10 is a sectional view showing an ignition device with a series gap employing the discharge tube described above.
Figure 11:
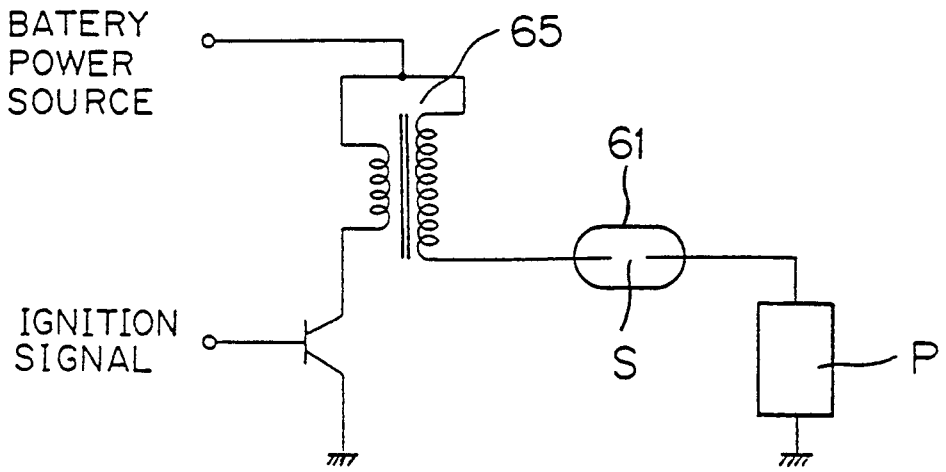
FIG. 11 PRIOR ART
FIG. 11 is a circuit diagram of the ignition device with a series gap.
Figure 12:
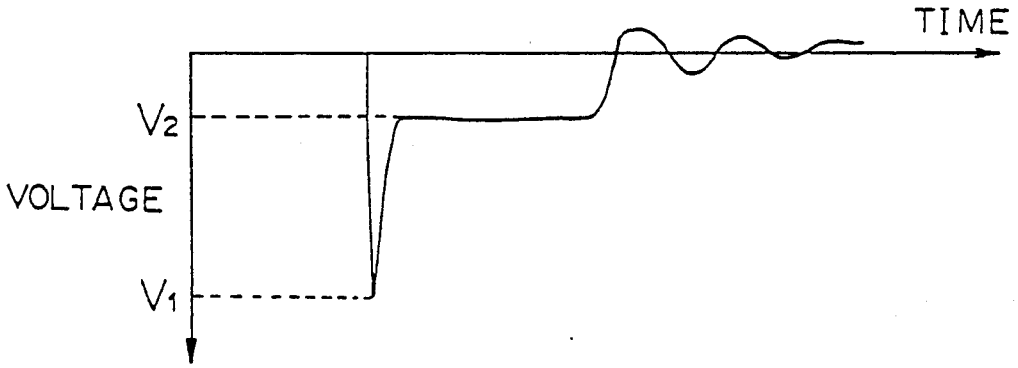
FIG. 12 PRIOR ART
FIG. 12 is a view illustrating a voltage characteristic of a discharge tube.

The discharge tube 1 having the electrodes 6 of the Rogosky type described above was formed and various experiments were conducted. Such experiments revealed that stabilization of the discharge voltage $V_1$ in the voltage characteristic of discharge shown in FIG. 10 depends upon a material and a shape of the cathode side electrode from which electrons are discharged, a distance between the electrodes, and a kind and a pressure of enclosed gas, and the magnitude of the discharge maintaining voltage $V_2$ depends upon conditions of the distance between the electrodes and enclosed gas.

Accordingly, it was made clear that, if at least the cathode side electrode is of the Rogosky type having similar holes perforated therein as in the embodiment described above, then the configuration of the anode side electrode does not matter very much. Thus, an embodiment wherein the cathode side electrode is of the Rogosky type having holes formed therein and only the anode side electrode is modified will be described below. It is to be noted that, since the structure of the cathode side electrode is the same as in the embodiment described above, description thereof is omitted herein.

Figure 2A:
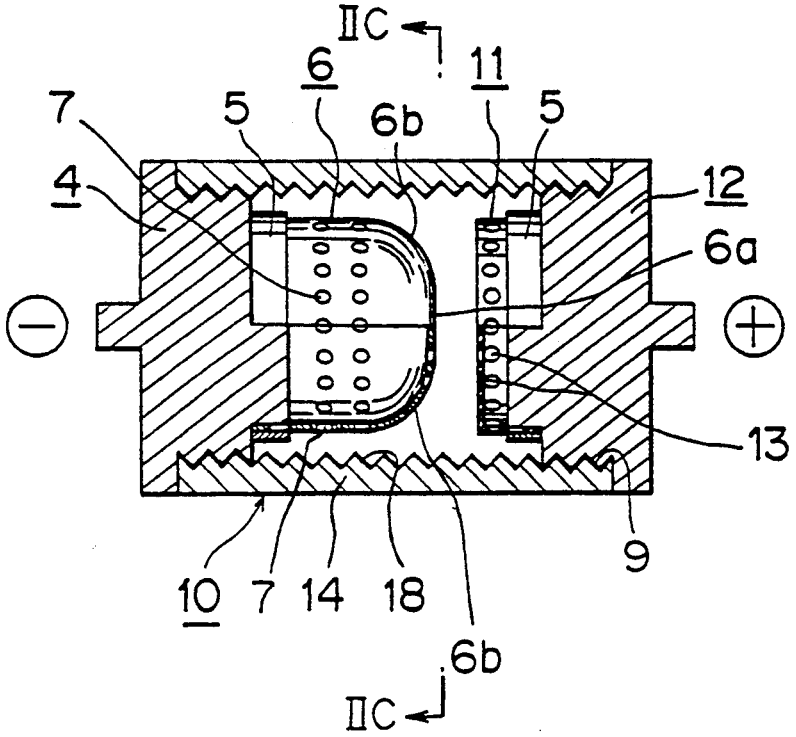
FIGS. 2A and 2B are sectional views showing embodiments wherein part of the embodiment described above is modified.
Figure 2C:
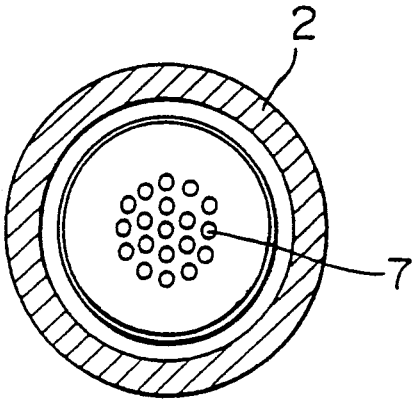
FIG. 2C is a sectional view taken along the line 2C—2C of FIG. 2A.
Figure 2B:
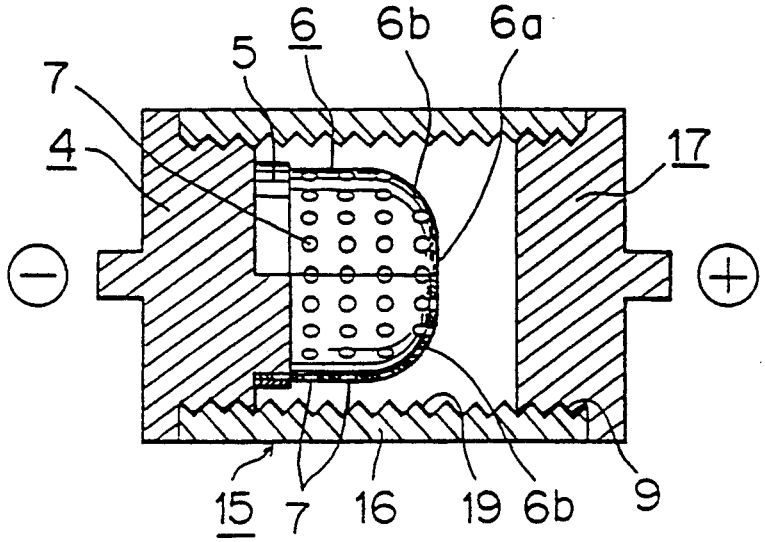

FIGS. 2A and 2B show discharge tubes in each of which an anode side electrode is formed into a flat plate configuration. In the discharge tube shown in FIG. 2A, small holes 7 are formed only in the end face 6*a* of the end portion of the cathode side electrode, and no small holes 7 are formed in the circumferential edge portion 6*b*, as will be best seen from FIG. 2C. In the case of the discharge tube 10 of FIG. 2A, an electrode 11 substantially in the form of a disk is provided on an electrode base 12 with a metal ring 5 interposed therebetween, and a large number of small holes 13 are formed in a surface of the electrode 11. The method of forming the small holes 13 is the same as the working method described in connection with the embodiment described above.

However, in the case of the present embodiment, the voltage characteristic obtained is substantially similar to that of the discharge tube 1 of the embodiment described above, and further since the anode side electrode 11 is changed from the Rogosky type to the flat plate type, the length of a casing 14 in the longitudinal direction can be reduced, and the entire discharge tube 10 can be reduced in size. However, since the Rogosky type electrode 6 serves as a cathode and the flat plate-formed electrode 11 not of the Rogosky type serves as an anode, the discharge tube has a directivity and is not suitably used for an ac power source. This can be applied also to other embodiments hereinafter described.

To the contrary, in the case of the discharge tube 15 of FIG. 2B, an electrode base 17 serves also as an anode side electrode, and no small hole is formed in a surface of the electrode as distinct from FIG. 2A. However, since in this case the electrode base 17 serves also as an anode, the number of parts is reduced and the assembling facility is improved, but since the effective surface area of the electrode from which discharging takes place is reduced comparing with an electrode in which small holes are formed, the discharge tube is not suitably applied very much as a discharge tube which is to be used continuously due to an influence of exhaustion of the electrode by discharging.

It is to be noted that, in either of the embodiments described above, each of the anode side electrode bases 12 and 17 is screwed by way of a screw thread 18 or 19 formed on an inner periphery of the casing 14 or 16, and the screwed portion is sealed with a sealing material so that inert gas in the discharge tube 10 or 15 may not be leaked. Further, the coefficients of thermal expansion and so forth of the electrode bases 12 and 17 are made substantially equal to those of the individual casings 14 and 16.

Figure 3A:
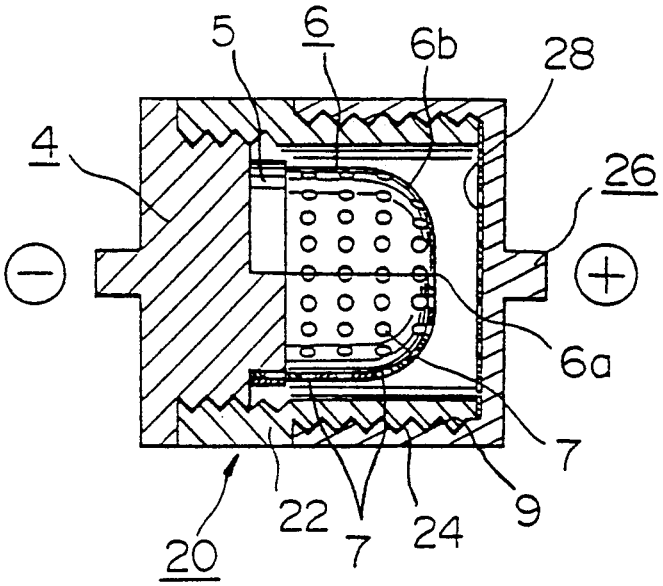
FIGS. 3A and 3B are sectional views showing embodiments wherein part of the embodiment described above is modified.
Figure 3B:
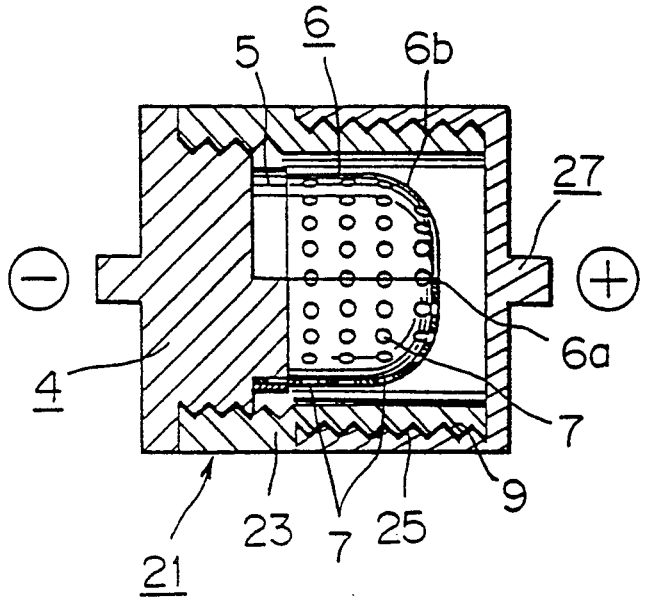

Discharge tubes 20 and 21 of FIGS. 3A and 3B correspond to the discharge tubes of FIGS. 2A and 2B which are further reduced in size, respectively. In particular, screw threads 24 and 25 are formed on outer peripheries of one end portions of individual casings 22 and 23, and individual anode side electrode plates 26 and 27 formed substantially into lid-like configurations are fitted around and screwed over the casing by way of the screw threads in such a manner as to cover over individual cathode side electrodes. In FIG. 3A, a thin plate 28 having holes perforated therein is put between the anode side electrode plate 26 and an anode side end face of the casing 22.

Thus, according to the embodiments described above, the length of the casings in the longitudinal direction can be further reduced, and since the individual anode side electrode plates 26 and 27 cover also over part of the cathode side electrodes 6 fitted around the casings, the change in voltage characteristic by conditions in use is eliminated. Further, in the case of the discharge tube of FIG. 3A, since the thin plate 28 having the small holes perforated therein is present, the effective area of the electrodes from which discharge can take place is increased, and the influence of exhaustion of the electrodes is decreased.

While each of the embodiments described so far is constituted such that the electrode bases are screwed to the opposite open end portions of the discharge tube and the screwed portion is sealed with the sealing material, the means for sealing the opposite open end portions of the discharge tube is not limited to those of the embodiments described above. In the following, embodiments which employ some other sealing means will be described. It is to be noted that, in each of the following embodiments, a pair of electrodes are both of the Rogosky type having holes formed therein, and there is no directivity in a discharge tube that one of the electrodes serves as a cathode and the other electrode serves as an anode.

Figure 4:
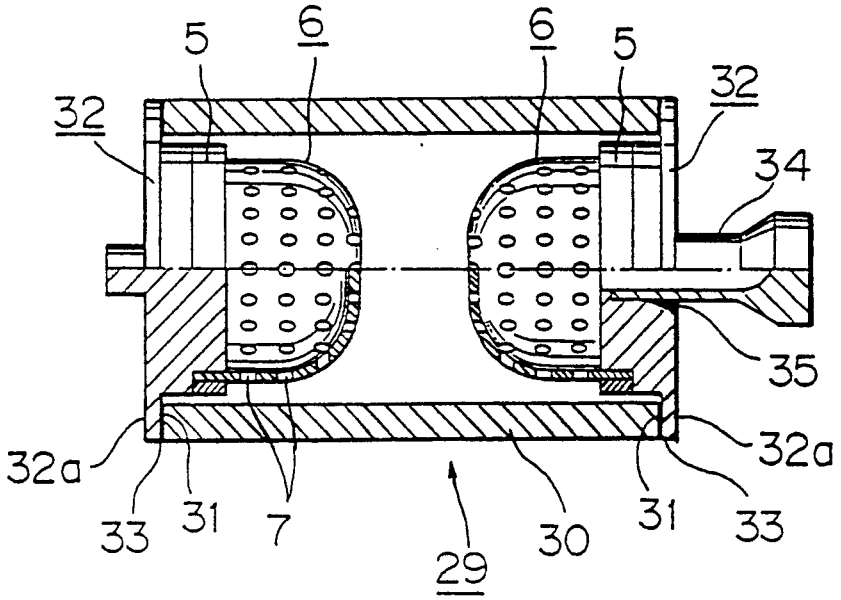
FIGS. 4 to 8 are sectional views showing other embodiments.

A discharge tube 29 shown in FIG. 4 includes a casing 30 formed from a ceramics material and having a metallization at each of a pair of open end faces 31 thereof. Similarly as in the embodiments described hereinabove, airtight joining by brazing or by an oxide solder 33 is performed in a condition wherein a flange portion 32*a* of an electrode base 32 on which an electrode 6 is mounted by force fitting of a metal ring 5 is held in a closely contacting relationship with the corresponding open end face 31. Further, while an enclosing pipe 34 for enclosing inert gas such as nitrogen gas into the tube is mounted on one of the electrode bases 32, brazing 35 is also applied between the enclosing pipe 34 and the electrode base 32, and the enclosing pipe 34 is sealed with a predetermined sealing material after enclosure of gas into the tube.

Here, the individual joining portions 33 and 35 by the brazing or the oxide solder described above can preferably stand at least against 300° C. from various conditions of use of the discharge tube. Further, since there is the possibility that a high temperature atmosphere may be formed by the joining operation described above and the electrode 6 mounted on the electrode base 32 may be oxidized, there is the necessity of performing the joining operation in an oxygen-free condition such as in forming gas wherein $H_2$ and $N_2$ are mixed, in vacuum or in inert gas.

Meanwhile, in the case of the present embodiment, particularly there is the necessity of making the coefficients of thermal expansion of the electrode base 32 and the casing 30 substantially equal to each other to prevent occurrence of a crack or the like at the joining portion 33 by a heat cycle.

Figure 5:
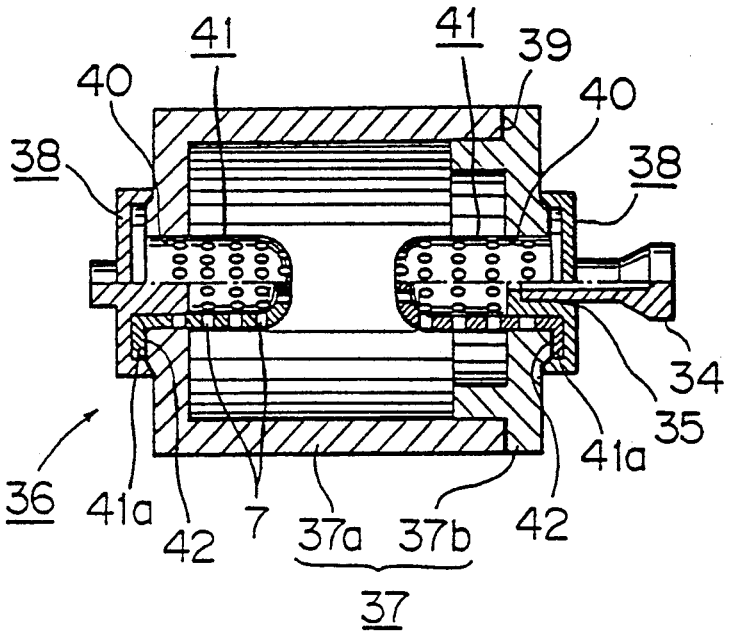

A discharge tube 36 shown in FIG. 5 is formed such that the area of an electrode base 38 for enclosing an open end portion of a casing 37 is reduced. The casing 37 is constituted from a body portion 37*a* having an end portion thereof drawn inwardly and opened at the other end thereof, and a lid portion 37*b* for fitting with the open end portion of the body portion 37*a*, and the body portion 37*a* and the lid portion 37*b* are butt joined in an airtight relationship by an oxide solder 39 or the like.

Meanwhile, an electrode 41 of the Rogosky type adapted to be fitted into each of openings 40 of the body portion 37*a* and the lid portion 37*b* and having a smaller diameter than that in each of the embodiments described above is constituted such that a flange portion 41*a* formed at a base end thereof is engaged with a circumferential edge portion of the opening 40. The circumferential edge portion of the opening 40 is processed by metallization, and brazing 42 is performed while the flange portion 41*a* engaged with the circumferential edge portion is held by the electrode base 38 formed substantially into a lid configuration. Consequently, the open end portion of the casing 37 is sealed while maintaining communication between the electrode base 38 and the electrode 41.

It is to be noted that the conditions that the coefficient of thermal expansion of the electrode bases 38 is made substantially same as that of the casing 37, that the joining operation is performed in an oxygen-free condition, of heat resisting temperatures at the individual joining portions and so forth are similar to those of the embodiments described above.

Figure 6:
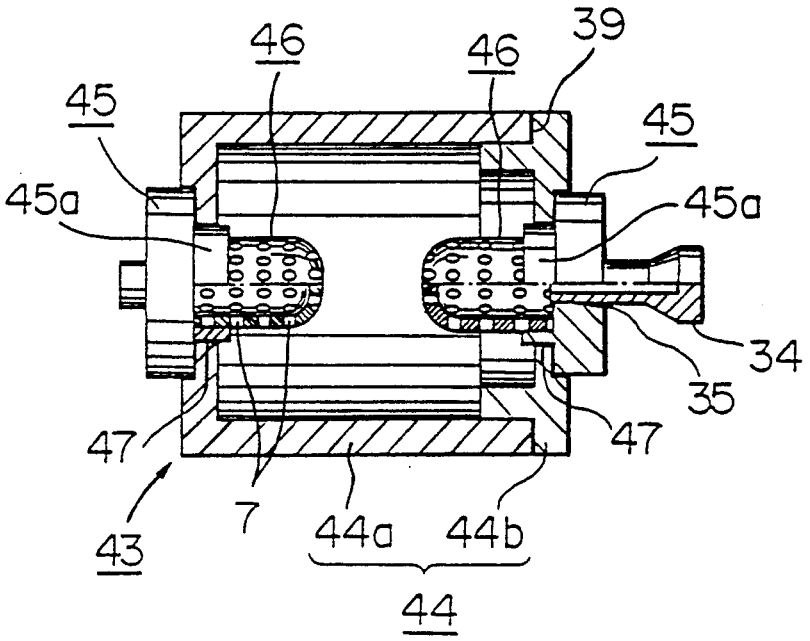

Also a discharge tube 43 shown in FIG. 6 is constituted such that the area of an electrode base 45 for enclosing each open end portion of a casing 44 is reduced similarly as in the embodiments described above. An electrode plate 46 of the Rogosky type is mounted on each of the electrode bases 45 by brazing in a condition wherein the electrode 46 is fitted in a hub portion 45*a* of the electrode base 45, and sealing of the casing 44 is attained by the electrode base 45 butt joined in an airtight relationship to the open end portion of the casing 44 by brazing or an oxide solder 47.

It is to be noted that the conditions that the casing 44 is constituted from a body portion 44*a* and a lid portion 44*b*, that the coefficient of thermal expansion of the electrode bases 45 is made substantially same as that of the casing 44, that the joining operation is performed in an oxygen-free condition and so forth are similar as in the embodiments described hereinabove.

While in the individual embodiments described so far the various discharge tubes are shown wherein at least a cathode side electrode is of the Rogosky type having holes perforated therein as an electrode which is formed in a non-acute contour at an end portion thereof and a large number of irregularities such as concave or convex portions are formed at least on the anode side, the configuration of an electrode which has characteristics of a uniform electric field and a non-uniform electric field is not specifically limited to that of the Rogosky type having holes formed therein. In the following, a configuration of an electrode of a type other than the Rogosky type having holes formed therein which has both characteristics of a uniform electric field and a non-uniform electric field will be described. It is to be noted that a discharge tube in each of the following embodiments is constituted such that a pair of electrodes have a same configuration and the discharge tube itself does not have a directivity.

Figure 7:
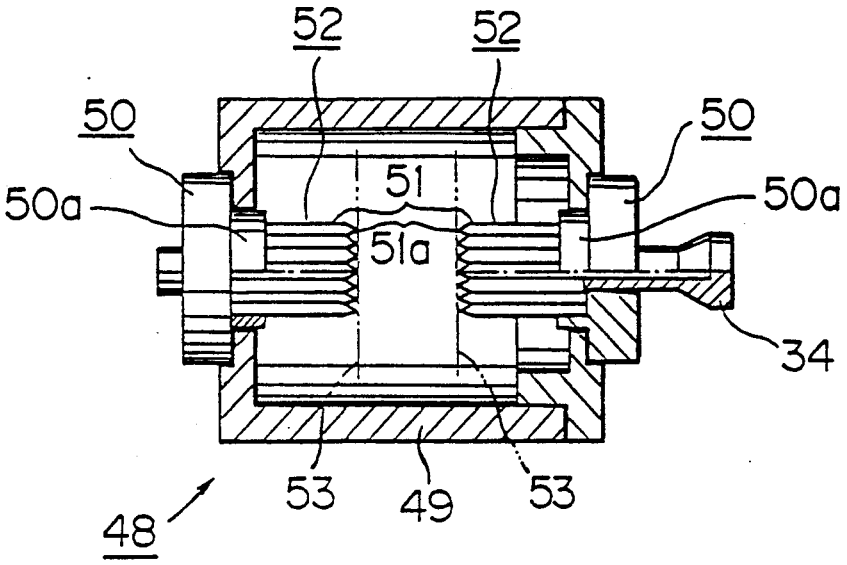

A discharge tube 48 shown in FIG. 7 is constituted such that a needle set electrode 52 formed by bundling a plurality of needle-formed electrodes 51 so as to form a non-uniform electric field is fitted in a hub portion 50*a* of each of a pair of electrode bases 50 for sealing open end portions of a casing 49, and ends 51*a* of the individual needle-shaped electrodes 51 are located on imaginary planes 53 so as to form a uniform electric field.

With the construction, the characteristic of a non-uniform electric field can be further intensified comparing with such an electrode of the Rogosky type having holes perforated therein as described above, and the discharge voltage $V_1$ can be stabilized further. Further, if each of the imaginary planes 53 is modified into a Rogosky configuration and the individual needle-shaped electrodes 51 are disposed such that the ends 51*a* thereof may be located on the Rogosky type imaginary planes, then a further preferable electrode can be obtained.

Figure 8:
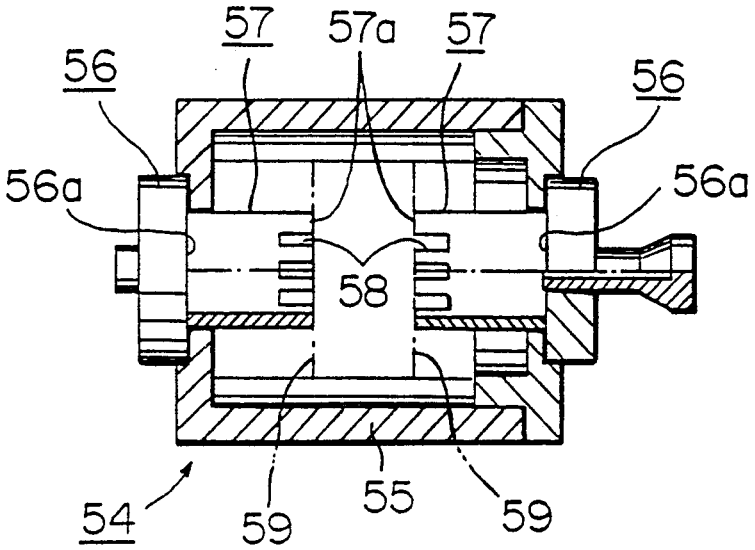
Figure 9:
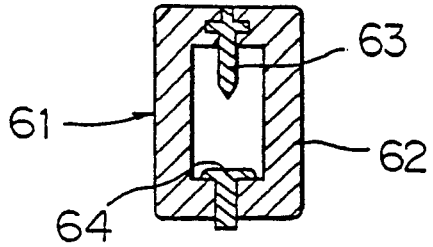
FIG. 9 is a sectional view showing a conventional discharge tube.

To the contrary, a discharge tube 54 shown in FIG. 8 is constituted such that a substantially pipe-shaped electrode 57 having a plurality of recessed portions 58 formed at an end face 57*a* thereof so as to form a non-uniform electric field is securely mounted on an inner face 56*a* of each of a pair of electrode bases 56 for sealing open end portions of a casing 55 and each of the end faces 57*a* is located in an imaginary plane 59 so as to form a uniform electric field.

With such construction as described above, the characteristic of a non-uniform electric field can be intensified further, and the discharge voltage $V_1$ can be stabilized. Further, if the electrodes 57 are disposed such that the end faces 57*a* thereof are located in the imaginary planes 59 formed as of the Rogosky type, then a further preferable electrode can be obtained.

It is to be noted that while in each of the embodiments described so far nitrogen gas is illustrated as inert gas to be enclosed in the discharge tube, such nitrogen gas is optimum particularly for an ignition device with a series gap of an automobile engine or the like, and if inert gas to be enclosed is changed to various gases such as air, argon, helium or the like, then the discharge voltage of the discharge tube can be changed from several tens of kilovolts to several tens of volts depending upon the gas enclosed. Accordingly, the electrode structure of the present invention can be applied not only to a discharge tube of an ignition device with a series gap but to discharge tubes of various types such as a discharge tube for a flash device, a discharge tube used for a lightening arrester of a telephone switchboard or the like.

Further, the electrode of the Rogosky type shown in the embodiments described hereinabove is an example of a configuration of a substantially flat plate-formed electrode wherein an end portion is formed into a non-acute configuration, and the discharge tube is not limited to that of the specific configuration. For example, similar effects can be obtained even where an end portion of an electrode is formed into a substantially semi-spherical configuration having a large radius.

As apparent from the foregoing description, according to the present invention, since substantially opposing end portions of a pair of electrodes are each formed into a non-acute contour and a large number of irregularities such as concave or convex portions are formed on a surface at least of the cathode side electrode, a stabilized high discharge voltage can be obtained from an initial stage of discharging with a comparatively small distance between the electrodes. Further, since the surface area of the electrodes is great, exhaustion of the electrodes are dispersed, and the electrodes are superior in durability. Further, since the distance between the electrodes is small, the discharge maintaining voltage is low and the energy loss is decreased.

What is claimed is:

1. A discharge tube comprising:

a casing; and a pair of electrode means including anode side electrode means and cathode side electrode means provided opposite each other within said casing to cause a discharge therebetween, said anode side electrode means and said cathode side electrode means having opposing end portions formed in a generally non-acute contour, the opposing end portions of at least said cathode side electrode means includes a planar face substantially opposing the other electrode means and a curved peripheral portion around said planar face, said planar face being formed with a multiplicity of cutouts therein wherein said curved peripheral portion around said planar face is also formed with cutouts such that a density of cutouts in said planar face is larger than that in said curved peripheral portion.

2. A discharge tube according to claim 1, wherein each of the opposing end portions of both the anode side electrode means and the cathode side electrode means includes a planar face substantially opposing the other electrode means and a curved peripheral portion around said planar face to recede away from said other electrode means.

3. A discharge tube according to claim 1, wherein said casing has opposite open ends, each electrode means includes an electrode base adapted to block said opposite open ends and has a substantially equal coefficient of thermal expansion to said casing and said electrode means mounted on said electrode base.

4. A discharge tube according to claim 3, wherein said electrode base is screwed into said casing.

5. A discharge tube for use in an ignition device with a series gap for an engine, the discharge tube comprising:

a casing; and a first electrode means including an anode side electrode means;

a second electrode means including a cathode side electrode means, said first and second electrodes means being positioned opposite each other within said casing to cause a discharge therebetween, the anode side electrode means and the cathode side electrode means each having an opposing end portion formed in a generally non-acute contour, the opposing end of at least said cathode side electrode means being formed with a planar face substantially opposing the anode side electrode means and a curved peripheral portion around the planar face, and the planar face having defined therein a plurality of cutouts, wherein the curved peripheral portion around the planar face is formed with cutouts such that a density of cutouts defined in the planar face is greater than that defined in the curved peripheral portion.

6. A discharge tube according to claim 5, wherein each of the opposing ends of both the anode side electrode means and the cathode side electrode means includes a planar face substantially opposing the other electrode means and a curved peripheral portion around the planar face, each of the opposing ends further having defined therein a plurality of cutouts.

7. A discharge tube according to claim 5, wherein said casing has opposite open ends, each electrode means includes an electrode base formed so as to enclose the opposite open ends, and each electrode base has a coefficient of thermal expansion substantially equal to said casing and to the corresponding electrode means mounted on the electrode base.

8. A discharge tube according to claim 7, wherein the electrode base of each electrode means is formed with an external thread so as to be screwed into said casing.

* * * * *